US012507841B2

(12) United States Patent
Liu et al.

(10) Patent No.: US 12,507,841 B2
(45) Date of Patent: Dec. 30, 2025

(54) TOILET TRAINER

(71) Applicant: Shenzhen Wenjian Technology Co., Ltd., Shenzhen (CN)

(72) Inventors: Zhi Liu, Shenzhen (CN); Tingting Yin, Shenzhen (CN)

(73) Assignee: Shenzhen Wenjian Technology Co., Ltd., Shenzhen (CN)

( * ) Notice: Subject to any disclaimer, the term of this patent is extended or adjusted under 35 U.S.C. 154(b) by 71 days.

(21) Appl. No.: 18/429,491

(22) Filed: Feb. 1, 2024

(65) Prior Publication Data

US 2025/0169660 A1 May 29, 2025

(30) Foreign Application Priority Data

Nov. 23, 2023 (CN) ..... 202311583358.7

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS 11,330,942 B1 * 5/2022 Bergman ..... A47K 11/04
11,793,369 B1 * 10/2023 Yang ..... A47K 11/04
12,285,139 B1 * 4/2025 Chen ..... E03D 11/025

* cited by examiner

*Primary Examiner* — Huyen D Le

(57) ABSTRACT

A toilet trainer includes: a hollow, first bowl defining a through hole; a hollow, second bowl; a compartment; and a seat assembly. In a first state, the first bowl, the second bowl, the compartment and the seat assembly are detachably connected to one another. In a second state, the second bowl is to receive at least a portion of the first bowl, the first bowl is in communication with the second bowl through the through hole, and a portion of the compartment passes through the through hole, which allows the compartment to be partially received in the first bowl and partially received in the second bowl.

10 Claims, 11 Drawing Sheets

TOILET TRAINER

CROSS REFERENCE TO RELATED APPLICATIONS

This application claims priority to Chinese Patent Application No. CN 202311583358.7, filed Nov. 23, 2023, which is hereby incorporated by reference herein as if set forth in its entirety.

TECHNICAL FIELD

The present disclosure generally relates to toilet trainers for children, and in particular relates to a toilet trainer that facilitates package and shipment.

BACKGROUND

There are various training apparatuses which are used to teach young children how to use a toilet. One example of a common training apparatus is a potty chair that includes a container and a seat of suitable size, which allows a young child to sit on the container. These potty chairs are portable and are handy for use as a preparatory device in teaching young children to use a conventional toilet. Although these conventional apparatuses meet basic requirements, there is still room for improvement and it is still useful and desirable to provide a new toilet trainer.

BRIEF DESCRIPTION OF DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
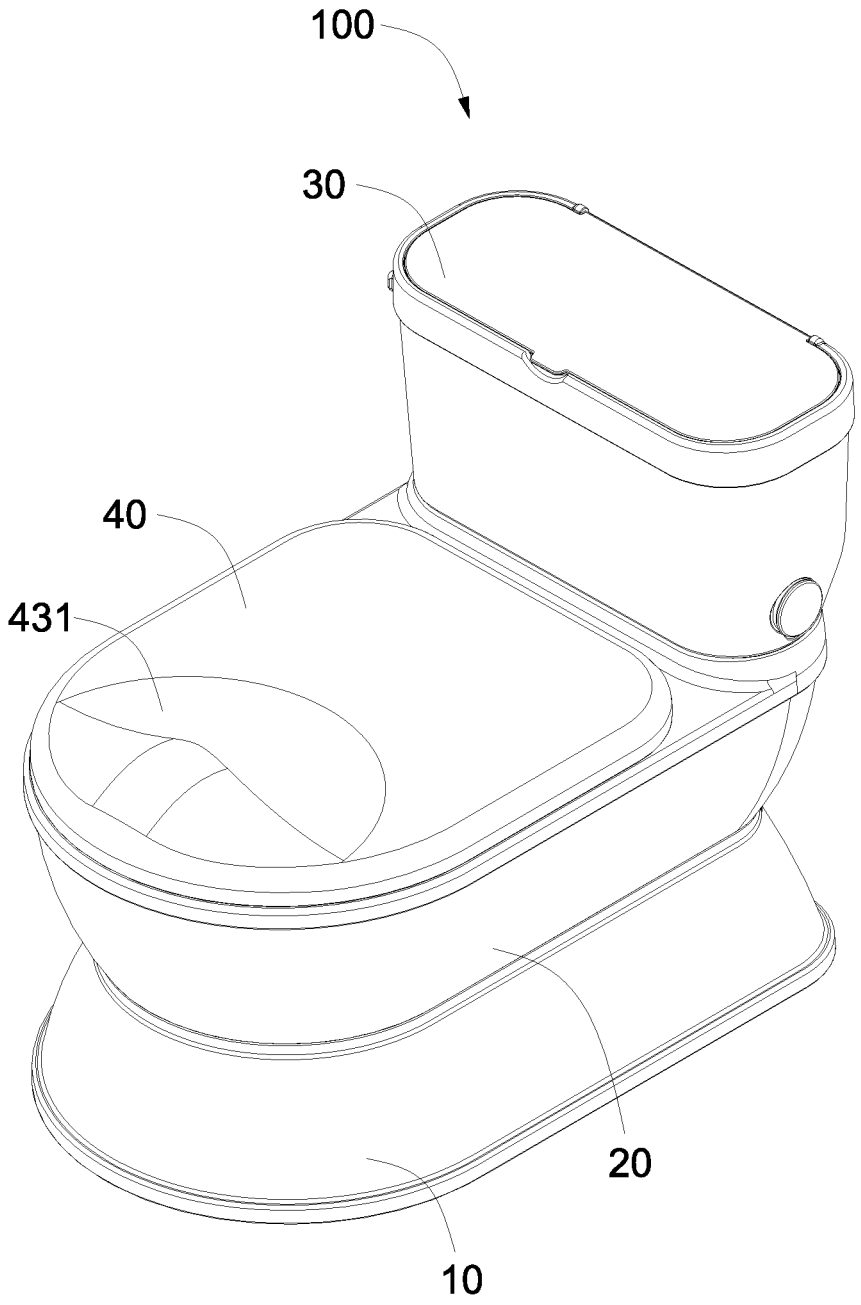
FIG. 1 is a perspective view of a toilet trainer in an assembled state according to one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

Figure 2:
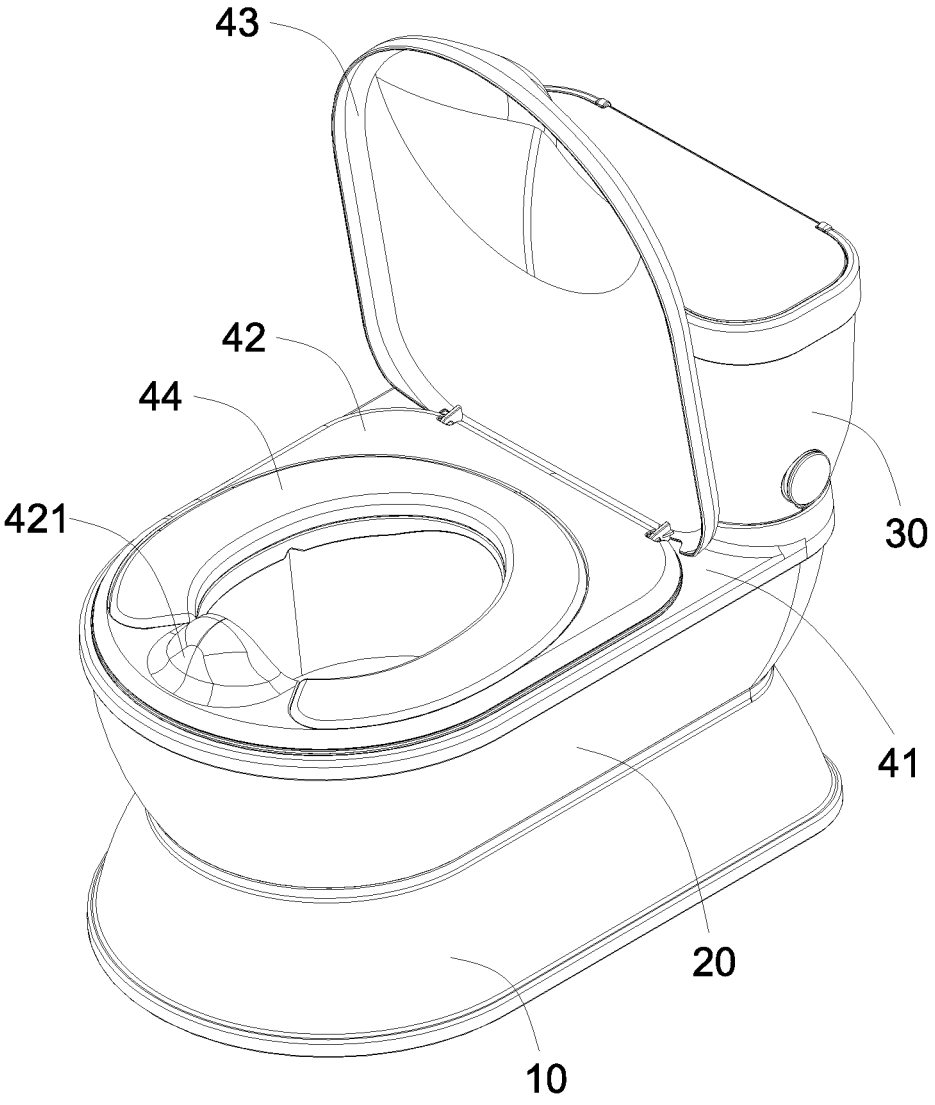
FIG. 2 shows that the cover of the seat assembly of the toilet trainer shown in FIG. 1 is rotated to an open position.
Figure 3:
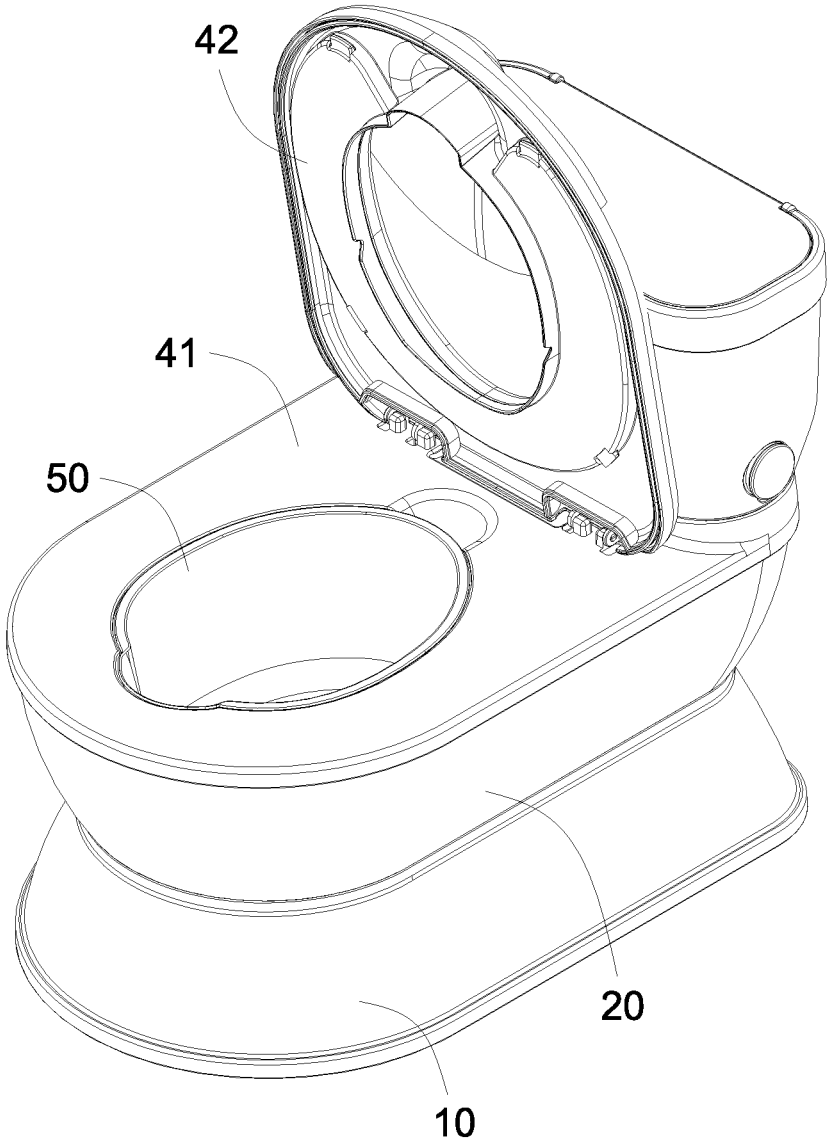
FIG. 3 shows that the seat of the seat assembly of the toilet trainer shown in FIG. 1 is rotated to an open position.

Referring to FIGS. 1 to 3, in one embodiment, a toilet trainer 100 includes a hollow first bowl 10, a hollow second bowl 20, a compartment 30 and a seat assembly 40. The first bowl 10 is provided with a through hole 101 (see FIG. 5). In a first state (i.e., the assembled state) shown in FIG. 1, the first bowl 10, the second bowl 20, the compartment 30 and the seat assembly 40 are detachably connected to one another. In a second state (i.e., packaged state, see FIGS. 6, 8 and 9), the second bowl 20 is to receive at least a portion of the first bowl 10; the first bowl 10 and the second bowl 20 are in communication with each other through the through hole 101, and a portion of the compartment 30 passes through the through hole 101, which allows the compartment 30 to be partially received in the first bowl 10 and partially received in the second bowl 20.

Figure 6:
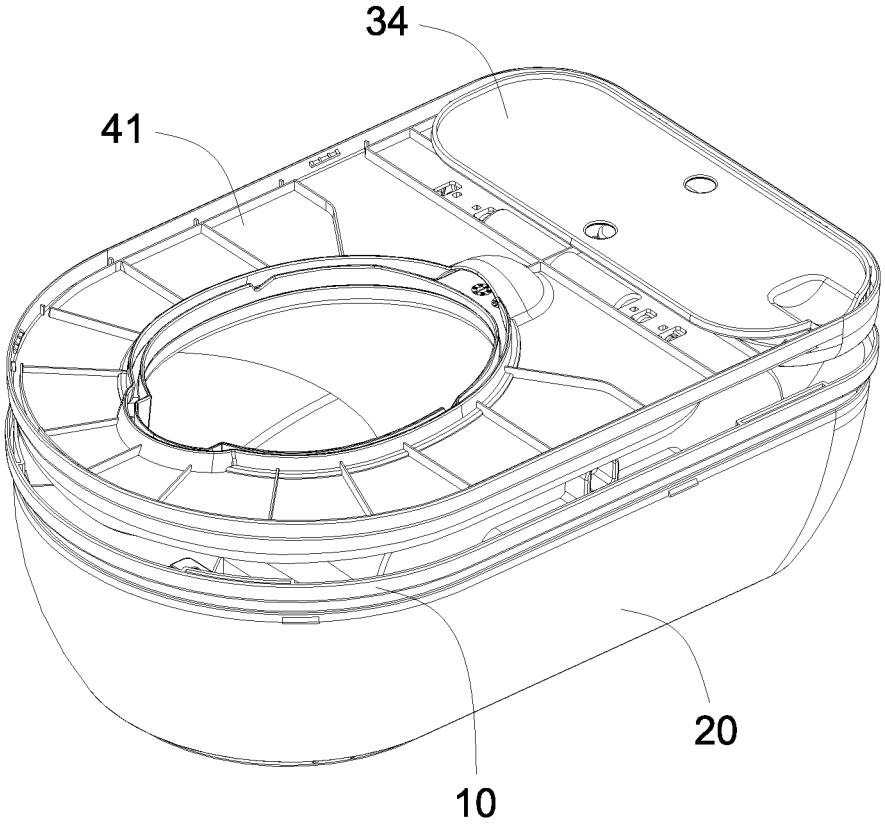
FIG. 6 is a perspective view of the toilet trainer in a packaged state according to one embodiment.
Figure 7:
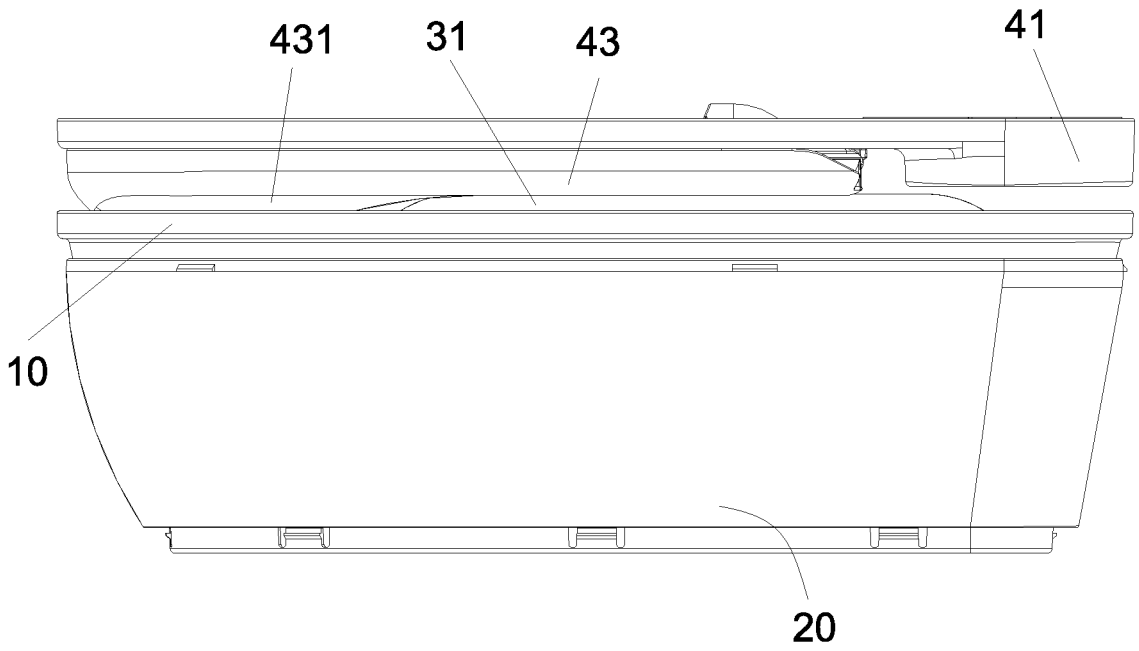
FIG. 7 is a side view of the toilet trainer in a packaged state according to one embodiment.

With such configuration, the assembly shown in FIG. 6 has a smaller height relative to the toilet trainer 100 shown in FIG. 1, making the assembly have a more compact structure and take up less space. Therefore, when it needs to package and ship the toilet trainer 100, the components of the toilet trainer 100 can be arranged according to FIG. 6, so that the toilet trainer 100 is transformed into the packaged state shown in FIG. 6, allowing the toilet trainer 100 in the packaged state to be put into a packaging box.

Figure 4:
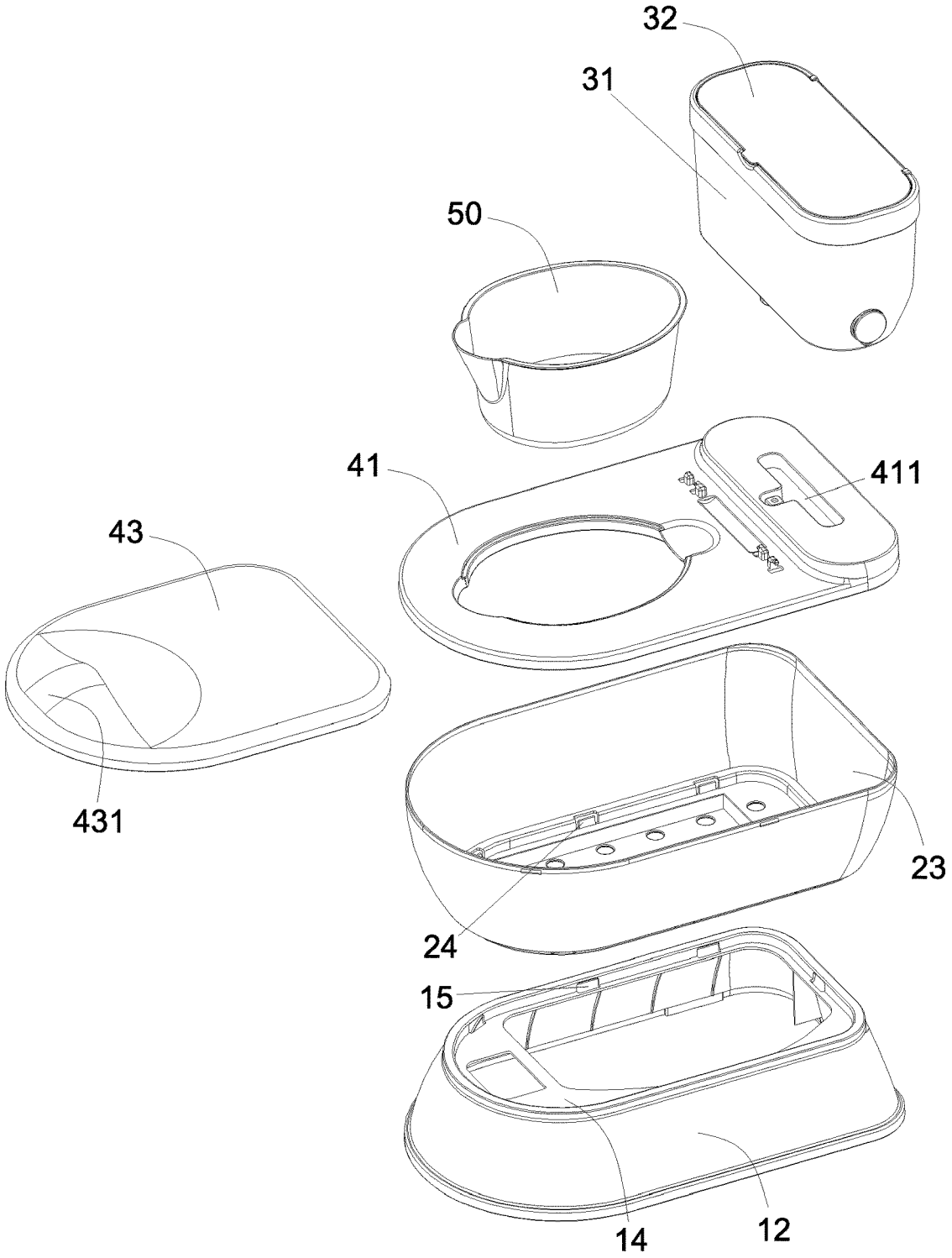
FIG. 4 is an exploded view of the toilet trainer according to one embodiment.
Figure 5:
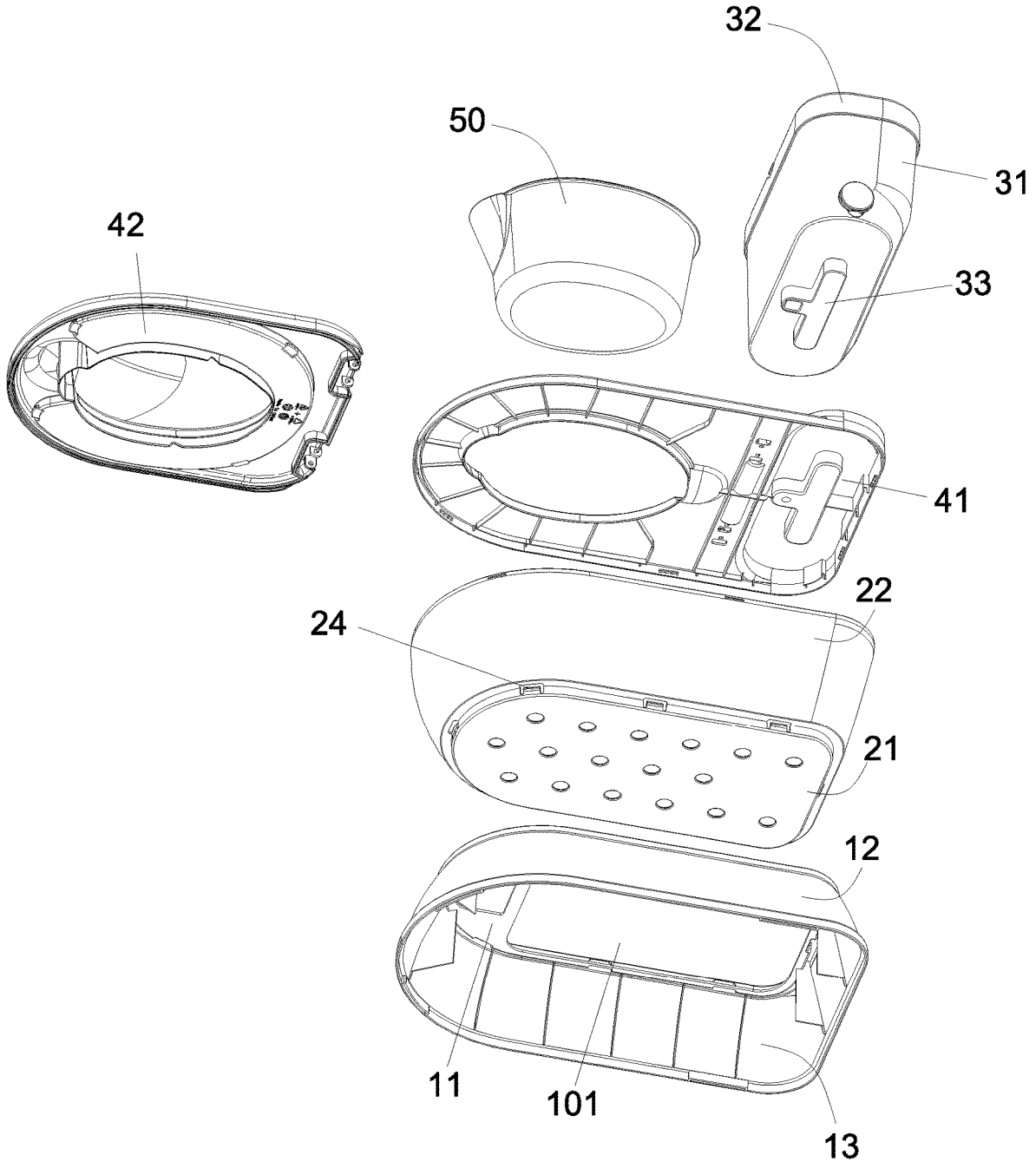
FIG. 5 is an exploded view of the toilet trainer viewed from another perspective.

Referring to FIGS. 4 and 5, in one embodiment, the first bowl 10 includes a flat plate 11 and a side wall 12 surrounding the flat plate 11. The flat plate 11 and the side wall 12 form a receiving chamber 13 with an open end opposite to the first plate 11. The through hole 101 is defined in the flat plate 11. In one embodiment, the side wall 12 is inclined relative to the flat plate 11, and the area surrounded by the open end of the receiving chamber 13 is larger than the area of the flat plate 11.

In one embodiment, the second bowl 20 includes a flat plate 21 and a side wall 22 connected to the flat plate 21. The flat plate 21 and the side wall 22 form a receiving chamber 23 with an open end. In the second state shown in FIG. 6, most of the first bowl 10 is received in the receiving chamber 23. It should be noted that the first bowl 10 may have different heights in different embodiments. That is to say, in some embodiments, the first bowl 10 may have a smaller height, so that the entire first bowl 10 can be completely received in the receiving chamber 23. In the second state shown in FIG. 8, most of the compartment 30 is received in the receiving chamber 13 of the first bowl 10. It should be noted that the compartment 30 may have different sizes in different embodiments. That is to say, in some embodiments, the size of the compartment 30 may allow the entire compartment 30 to be accommodated in the receiving chamber 13.

In one embodiment, the second bowl 20 is stacked on the first bowl 10 and is detachably connected to the first bowl 10. For example, referring to FIGS. 4 and 5, the flat plate 21 extends inwardly relative to one end of the side wall 22 connected thereto, and the flat plate 11 and the side wall 12 form a receiving cavity 14 with an open end. The receiving cavity 14 and the receiving chamber 13 are located on opposite sides of the flat plate 11. The shape and size of the receiving cavity 14 are determined according to the configuration of the flat plate 21 so that the flat plate 21 can be properly received in the receiving cavity 14. The flat plate 21 is restricted by the inner side surface of the receiving cavity 14 so that the second bowl 20 cannot move relative to the first bowl 10 along the lengthwise direction and widthwise direction of the first bowl 10.

In one embodiment, the second bowl 20 and the first bowl 10 can be detachably connected to each other by a mechanical interlocking mechanism. For example, referring to FIGS. 4 and 5, the second bowl 20 is provided with a number of hooks 24, and the first bowl 10 is correspondingly provided with a number of through holes 15, and each hook 24 securely engages the edge of its corresponding through hole 15, thereby detachably connecting the second bowl 20 to the first bowl 10. At this point, the flat plate 21 of the second bowl 20 and the flat plate 11 of the first bowl 10 are separated by a small gap. It is understood that the second bowl 20 and the first bowl 10 can also be detachably connected together through other conventional connection methods. For example, they can be removably connected to each other by fasteners such as screws.

Figure 8:
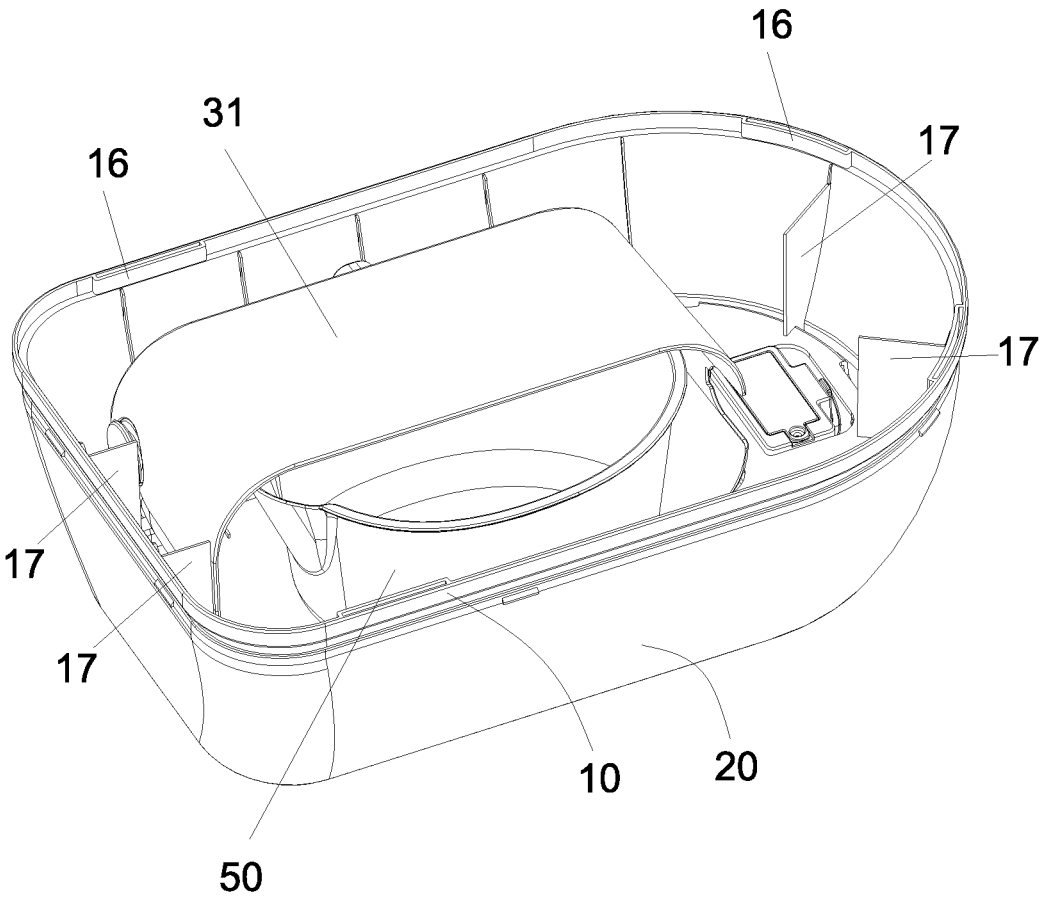
FIG. 8 is a perspective view of the toilet trainer shown in FIG. 6 with the toilet seat removed.

In one embodiment, the side wall 22 is inclined relative to the flat plate 21, and the area surrounded by the open end of the receiving chamber 23 is larger than the area of the flat plate 21. The dimensions of the side wall 22 and the plate 21 are set to allow the first bowl 10 to fit within the receiving chamber 23 of the second bowl 20. Referring to FIGS. 6 and 8, it can be seen that compared with the second bowl 20 stacked on the first bowl 10 in FIG. 1, when the first bowl 10 is received in the receiving chamber 23 of the second bowl 20, the height of them is significantly reduced.

Referring to FIGS. 2 to 4, in one embodiment, the seat assembly 40 includes a support plate 41 detachably connected to the second bowl 20, a seat 42 and a cover 43. The seat 42 and the cover 43 are rotatably connected to the support plate 41.

The support plate 41 has substantially the same shape as the open end of the receiving chamber 23 of the second bowl 20, so that the support plate 41 can just cover the open end of the receiving chamber 23. The support plate 41 is detachably connected to the side wall 22 of the second bowl 20, for example, by a mechanical interlock mechanism.

The cover 43 can rotate between the closed position shown in FIG. 1 and the open position shown in FIG. 2. When in use, the cover 43 can be rotated relative to the support plate 41 to the open position shown in FIG. 2.

The seat 42 can rotate between the closed position shown in FIG. 1 and the open position shown in FIG. 3. When in the closed position shown in FIG. 1, the seat 42 is in contact with the top surface of the support plate 41 and is supported by the support plate 41.

In one embodiment, the front end of the seat 42 is provided with a splash guard 421, and the cover 43 is provided with a hollow protrusion 431 to accommodate the splash guard 421. The splash guard 421 is to prevent urine from splashing. In one embodiment, the seat assembly 40 may further include a generally C-shaped seat cushion 44 (see FIG. 2) that provides padding and comfort for a child while seated.

In one embodiment, the toilet trainer 100 may further include an excrement container 50. In the first state, the excrement container 50 is received in the receiving chamber 23 of the second bowl 20. In one embodiment, the support plate 41 and the seat 42 are both provided with through holes communicating with the receiving chamber 23. In one embodiment, the excrement container 50 has a flange protruding from the outer side surface near its top, and the support plate 41 has a support rib protruding from the inner side surface of the through hole. The excrement container 50 can pass through the through hole of the support plate 41 and be received in the receiving chamber 23 of the second bowl 20. The flange of the excrement container 50 is in contact with the support rib in the through hole of the support plate 41 and is stably supported by the support rib. When needed, the excrement container 50 can be taken out from the receiving chamber 23 of the second bowl 20.

In one embodiment, the compartment 30 is hollow. The internal space of the compartment 30 can be used to store items used with the toilet trainer, such as toilet paper, diapers, pull-ups, briefs, clothes, and baby wipes. The appearance of the compartment 30 is similar to a typical tank found on an adult toilet, which aids in toilet training of children.

In one embodiment, the compartment 30 includes a hollow body 31 and a lid 32 detachably connected to the open end of the body 31. The compartment 30 is detachably connected to the support plate 41. For example, referring to FIGS. 4 and 5, the end surface of the body 31 opposite to the lid 32 is provided with a protrusion 33, and the support plate 41 is provided with a receiving hole 411 for receiving the protrusion 33. Through the engagement of the protrusion 33 with the receiving hole 411, the compartment 30 is detachably connected to the support plate 41.

Figure 9:
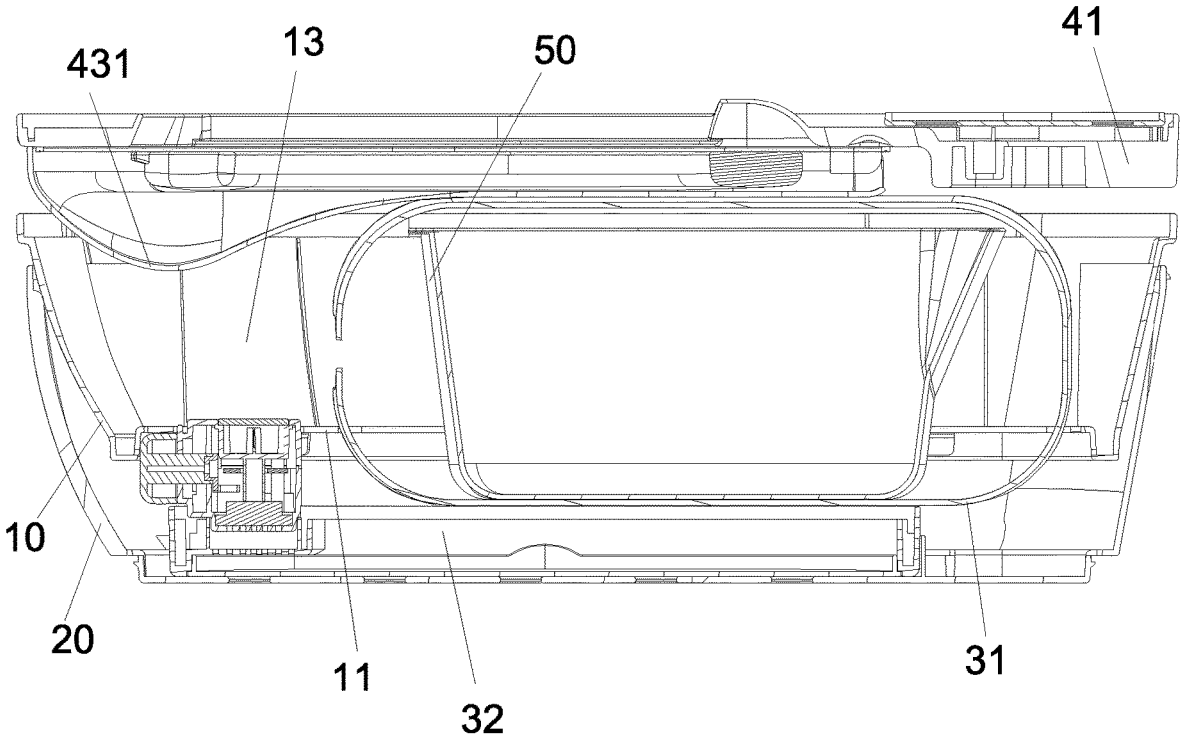
FIG. 9 is a cross-sectional view of the toilet trainer in a packaged state according to one embodiment.
Figure 10:
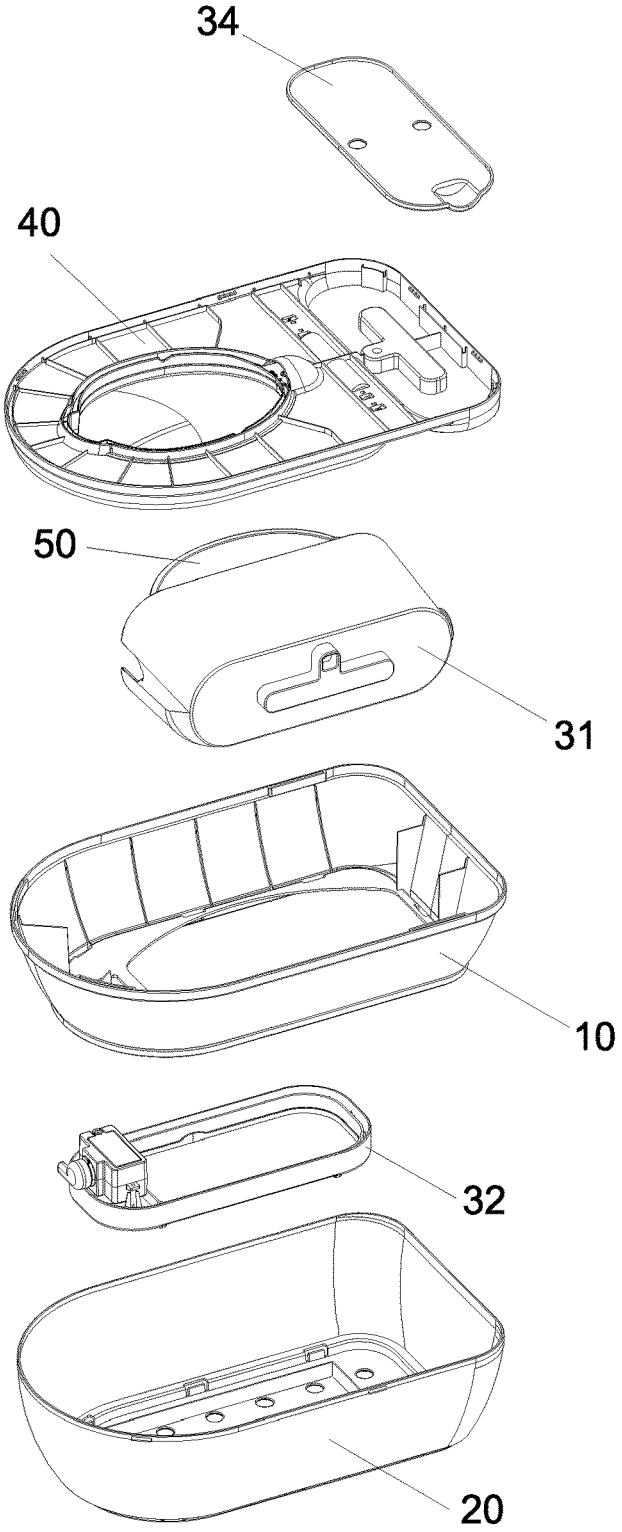
FIG. 10 is an exploded view of the toilet trainer in a packaged state according to one embodiment.

Referring to FIGS. 8 to 10, in one embodiment, in the second state, the excrement container 50 is partially received in the body 31 of the compartment 30. A portion of the body 31 passes through the through hole 101 of the first bowl 10, with most of the body 31 received in the first bowl 10 and a small portion of the body 31 that passes through the through hole 101 received in the second bowl 20. Since the excrement container 50 is partially received in the body 31, most of the excrement container 50 is received in the first bowl 10, and a small portion of the excrement container 50 is received in the second bowl 20. In one embodiment, in the first state shown in FIG. 1, the body 31 is in a vertical state. At this point, the open end of the body 31 faces upward. In the second state shown in FIG. 8, the body 31 is in a horizontal state, and at this point, the open end of the body 31 faces the inner surface of the side wall 12 of the first bowl 10. Generally, the width of the body 31 is smaller than its height, and the body 31 in the horizontal state shown in FIG. 8 requires less space in the vertical direction.

In one embodiment, the lid 32 is completely received in the receiving chamber 23 of the second bowl 20. Referring to FIGS. 9 and 10, the lid 32 is located on the flat plate 21 of the second bowl 20 and under a portion of the body 31 passing through the through hole 101 of the first bowl 10. In one embodiment, the body 31 is supported by the lid 32. Referring to FIGS. 6 and 10, in one embodiment, the compartment 30 further includes a partition 34 that divides the space within the body 31 into two parts. In the second state, the partition 34 is taken out from the compartment 30 and placed in a recess of the support plate 41 of the seat 40.

As shown in FIGS. 7 to 10, in one embodiment, in the second state, the seat assembly 40 is placed on the body 31, and the cover 43 is in direct contact with the body 31 and is supported by it. Since the body 31 is slightly higher than the open end of the first bowl 10, a gap is formed between the cover 43 and the open end of the first bowl 10. Only the protrusion 431 of the cover 43 of the seat assembly 40 is received in the receiving chamber 13 of the first bowl 10. It can be understood that in other embodiments, the splash guard 421 can be omitted, and correspondingly, the protrusion 431 can be omitted. At this point, the top surface of the cover 43 is substantially flat. In this way, in the second state, the seat assembly 40 placed on the body 31 is completely spaced apart from the open end of the first bowl 10. In other words, the seat assembly 40 is located outside the receiving chamber 13 of the first bowl 10, that is, the seat assembly 40 is not received in the first bowl 10. That is, the first bowl 10 is configured to receive at most a portion of the seat assembly 40.

Referring to FIG. 8, in one embodiment, the inner surface of the receiving chamber 13 of the first bowl 10 is provided with a number of protruding ribs 16, and the tops of the protruding ribs 16 are substantially flush with the open end of the receiving chamber 13. The protruding ribs 16 are each provided with receiving holes to facilitate the installation of the anti-slip strips on the protruding ribs 16. By contact between the anti-slip strips and the surface (e.g., the floor) supporting the toilet trainer 100, the toilet trainer 100 can be prevented from sliding easily relative to the surface. In one embodiment, the inner surface of the receiving chamber 13 of the first bowl 10 is further provided with a number of protruding portions 17, and the protruding portions 17 can prevent the second bowl 20 from being received in the first bowl 10.

Figure 11:
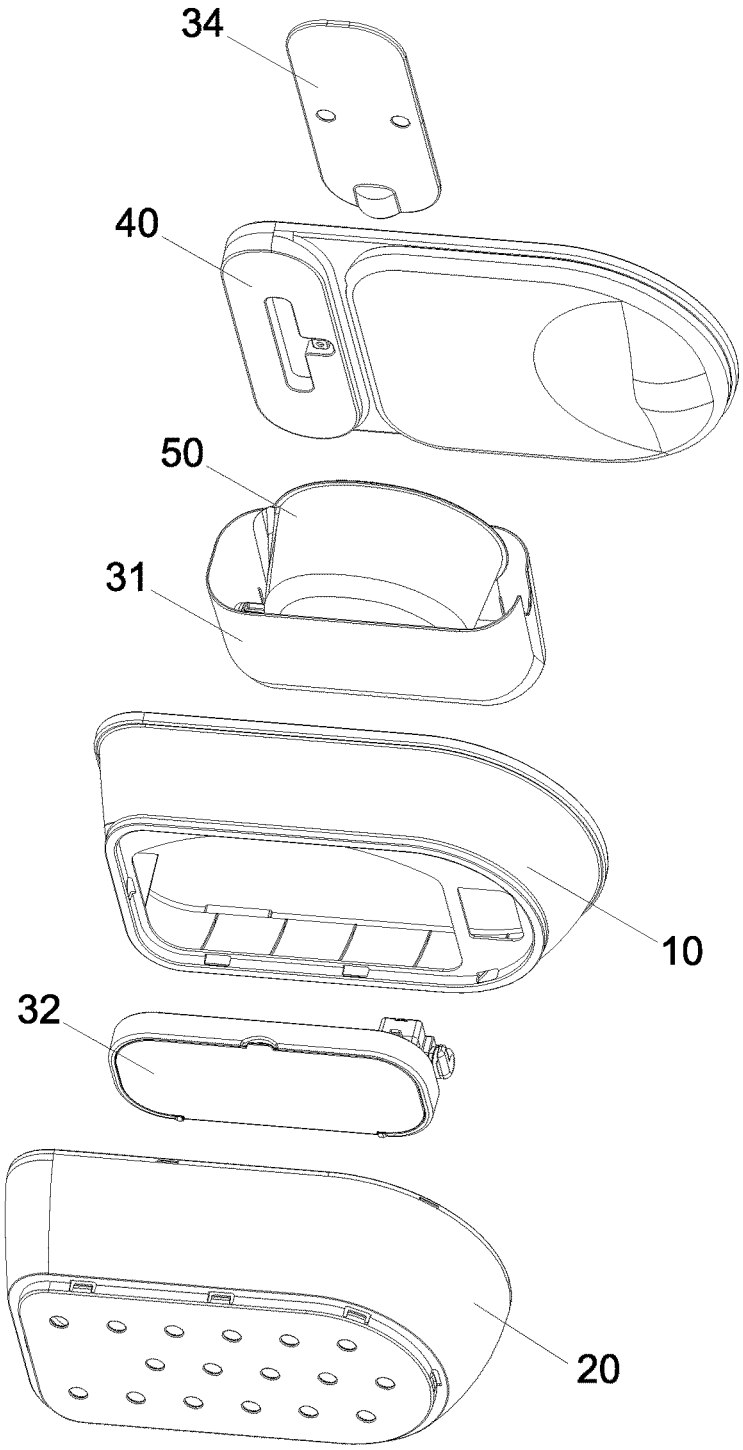
FIG. 11 is an exploded view of the toilet trainer in a packaged state viewed from another perspective.

Referring to FIGS. 10 and 11, when the toilet trainer 100 needs to be stored or shipped, the toilet trainer 100 is first disassembled. The lid 32 of the compartment 30 is removed from the body 31 and then placed into the receiving chamber 23 of the second bowl 20. The first bowl 10 is then placed into the receiving chamber 23 of the second bowl 20 from the open end of the second bowl 20. The partition 34 is then taken out of the body 31. The excrement container 50 is then placed into the body 31. The body 31 together with the excrement container 50 are then placed into the receiving chamber 13 of the first bowl 10, and they are moved to pass through the through hole 101 to be supported by the lid 32. Then, the cover 43 of the seat assembly 40 is placed toward the first bowl 10 and the seat assembly 40 is placed on the body 31. At this point, only the protrusion 431 of the cover 43 of the seat assembly 40 is received in the receiving chamber 13 of the first bowl 10. Then, the partition 34 is placed in the recess of the support plate 41 of the seat assembly 40. Finally, the assembly as shown in FIG. 6 is put into a packaging box for subsequent storage or shipment.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated.

What is claimed is:

1. A toilet trainer comprising:

a hollow, first bowl defining a through hole;

a hollow, second bowl;

a compartment; and a seat assembly;

wherein in a first state, the first bowl, the second bowl, the compartment and the seat assembly are detachably connected to one another; in a second state, the second bowl is configured to receive at least a portion of the first bowl, the first bowl is in communication with the second bowl through the through hole, and a portion of the compartment passes through the through hole, which allows the compartment to be partially received in the first bowl and partially received in the second bowl;

wherein the second bowl is stacked on the first bowl and is detachably connected to the first bowl.

2. The toilet trainer of claim 1, wherein the seat assembly comprises a support plate, a seat and a cover removably connected to the second bowl, and the seat and the cover are rotatably connected to the support plate.

3. The toilet trainer of claim 2, wherein the compartment is detachably connected to the support plate.

4. The toilet trainer of claim 2, wherein the seat comprises a splash guard at a front end thereof, and the cover comprises a hollow protrusion to accommodate the splash guard.

5. The toilet trainer of claim 4, wherein in the second state, the hollow protrusion is received in the first bowl.

6. The toilet trainer of claim 4, wherein the first bowl defines plurality of protruding portions on an inner surface thereof, and the protruding portions are configured to prevent the second bowl from being received in the first bowl.

7. The toilet trainer of claim 1, wherein in the second state, the first bowl is configured to receive at most a portion of the seat assembly.

8. A toilet trainer comprising:

a hollow, first bowl defining a through hole;

a hollow, second bowl;

a compartment;

a seat assembly; and an excrement container that is received in the second bowl in the first state;

wherein in a first state, the first bowl, the second bowl, the compartment and the seat assembly are detachably connected to one another; in a second state, the second bowl is configured to receive at least a portion of the first bowl, the first bowl is in communication with the second bowl through the through hole, and a portion of the compartment passes through the through hole, which allows the compartment to be partially received in the first bowl and partially received in the second bowl.

9. The toilet trainer of claim 8, wherein the compartment comprises a hollow body and a lid detachably connected to the body.

10. The toilet trainer of claim 9, wherein in the second state, the excrement container is partially received in the body, and the body and the excrement container are partially received in the first bowl and partially received in the second bowl.

* * * * *